US006250782B1

(12) United States Patent
Huang

(10) Patent No.: US 6,250,782 B1
(45) Date of Patent: Jun. 26, 2001

(54) COMBINABLE CHRISTMAS LIGHT

(76) Inventor: Shun-Feng Huang, 56, Minsheng Street, Fengyuan, Taichung Hsien (TW)

( * ) Notice: Subject to any disclaimer, the term of this patent is extended or adjusted under 35 U.S.C. 154(b) by 0 days.

(21) Appl. No.: 09/032,762

(22) Filed: Feb. 28, 1998

(51) Int. Cl.[7] ..... F21V 1/00
(52) U.S. Cl. ..... 362/391; 362/267; 362/249; 362/806
(58) Field of Search ..... 362/806, 391, 362/249, 244, 237, 267

(56) References Cited

U.S. PATENT DOCUMENTS 5,498,922 * 3/1996 Chang ..... 313/318.1
5,701,051 * 12/1997 Lin ..... 313/318.1
5,718,504 * 2/1998 Huang ..... 362/267
5,868,490 * 2/1999 Barthelmess ..... 362/252

* cited by examiner

*Primary Examiner*—Sandra O'Shea
*Assistant Examiner*—John A. Ward

(57) ABSTRACT

A combinable Christmas light includes a bulb axially securing into a base and a socket for receiving the base. A pair of lead-in wires from the bulb attach the bottom of the base and automatically engage with a pair of conduct plates of a pair of electrical wire inside the socket. This disclosure is characterized in that a pair of locking members in cooperation with an annular flange from the outer periphery of the socket can combine with an additional aspect such as a transparent shade an a cap in cooperation with a pair of recesses in the bottom of the socket can prevent external water from permeating into the socket.

2 Claims, 9 Drawing Sheets

COMBINABLE CHRISTMAS LIGHT

BACKGROUND OF THE INVENTION

The present invention relates to Christmas lights and more particularly to a Christmas light which can be combined with additional aspects in order to achieve greater decoration effect.

Typical Christmas light as shown in FIGS. 1–3 comprises a base 2, a bulb 1 axially engaged into the base with a pair of lead-in wires 11 extending out and attached to the lateral side of the bottom of the base and a socket 40 for receiving the base 2 and having a pair of slots symmetrically formed in opposing inner walls to respectively receive a pair of conduct plate 461 of a pair of electrical wires 402. The base 2 has a plurality of longitudinal ribs 23 to define a plurality of spaces 22 therebetween for dispersing heat from the bulb 1 and a tubular extension 24 under the ribs 23 within which is a notch 25. This type of Christmas light is featured in heat dispersing but lacks waterproof device and could not combine with additional aspects.

SUMMARY OF THE PRESENT INVENTION

The present invention has a main object to provide a combinable Christmas light which includes a waterproof device to prevent the external water from permeating into the light.

Another object of the present invention is to provide a combinable Christmas light which includes a pair of flexible locking members for the combination of additional aspects in order to achieve greater decoration effect.

Accordingly, the combinable Christmas light of the present invention generally comprises a bulb, a base and a socket which are conventional. The improvement is characterized in that, a cap in cooperation with a pair of slots in the bottom of the socket can provide waterproof effect and a pair of flexible locking members extending outward from opposing outer periphery of the socket can combine with additional aspects such as a transparent lamp shade in color in order to achieve greater decoration effect.

The present invention will become more fully understood by reference to the following detailed description thereof when read in conjunction with the attached drawings.

DETAILED DESCRIPTION OF THE PREFERRED EMBODIMENT

Figure 1:
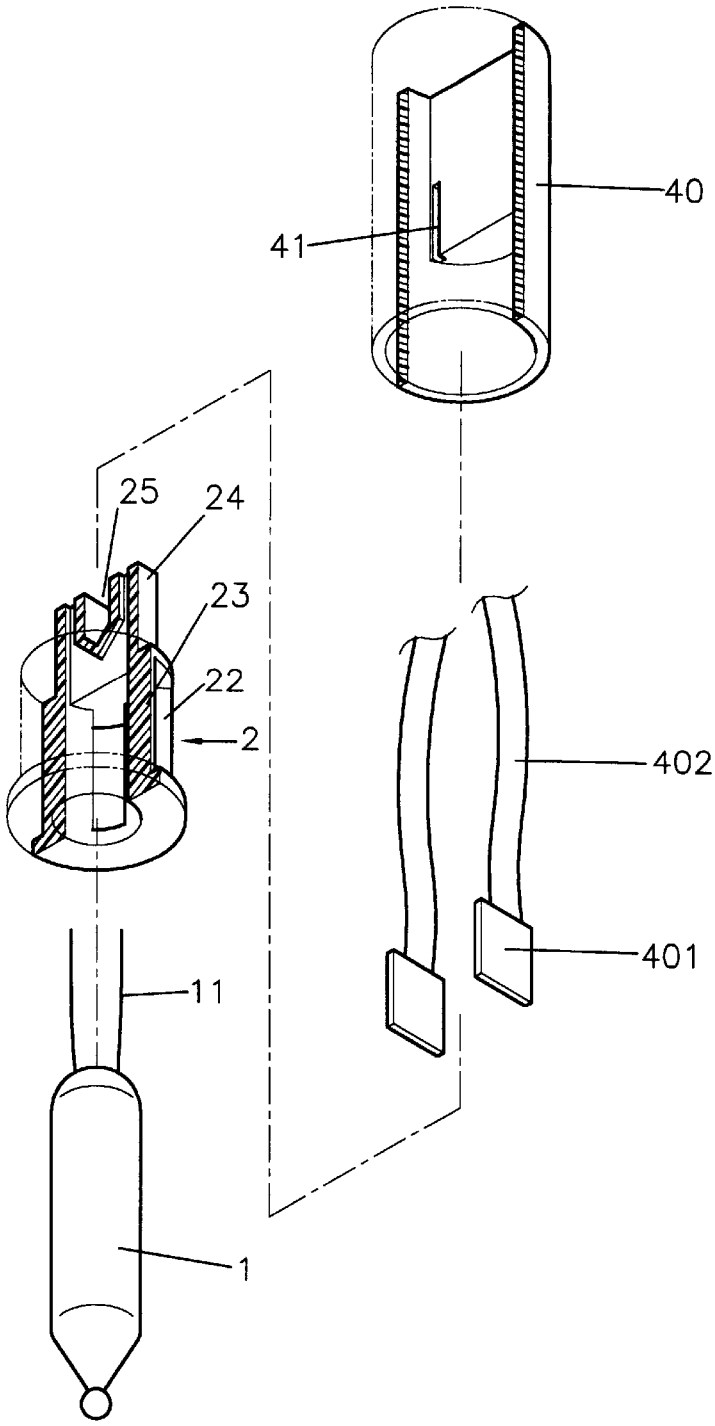
FIG. 1 PRIOR ART
FIG. 1 is an exploded perspective view to show a Christmas light of a prior art.
Figure 2:
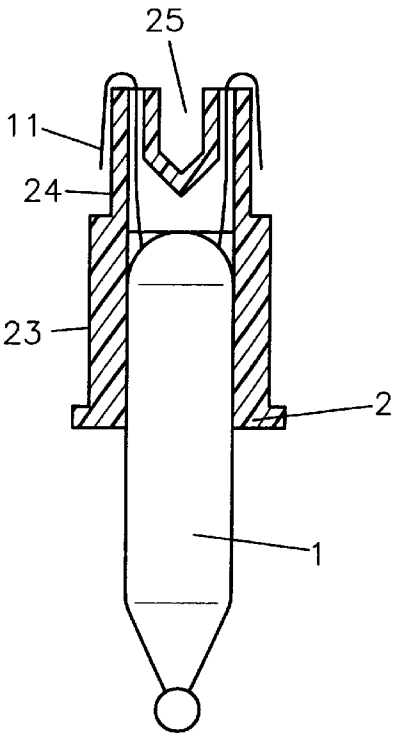
FIG. 2 PRIOR ART
FIGS. 2 and 3 are the sectional views of FIG. 1.
Figure 3:
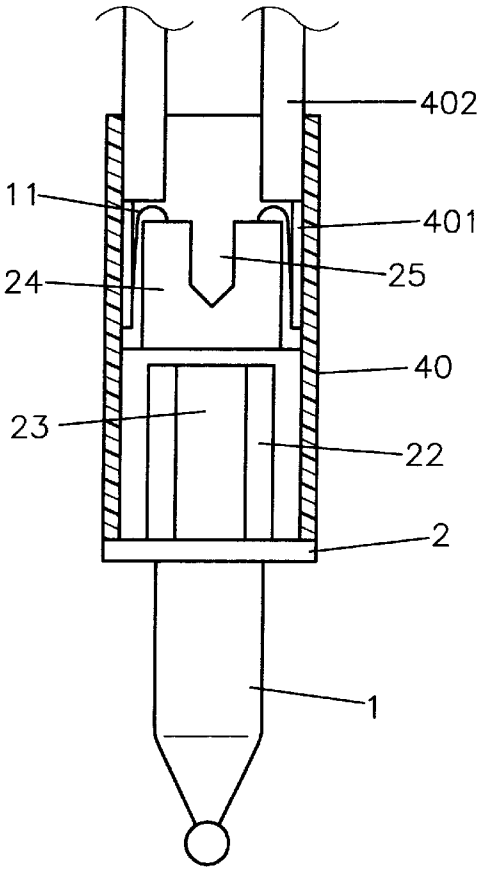
FIG. 3 PRIOR ART
Figure 4:
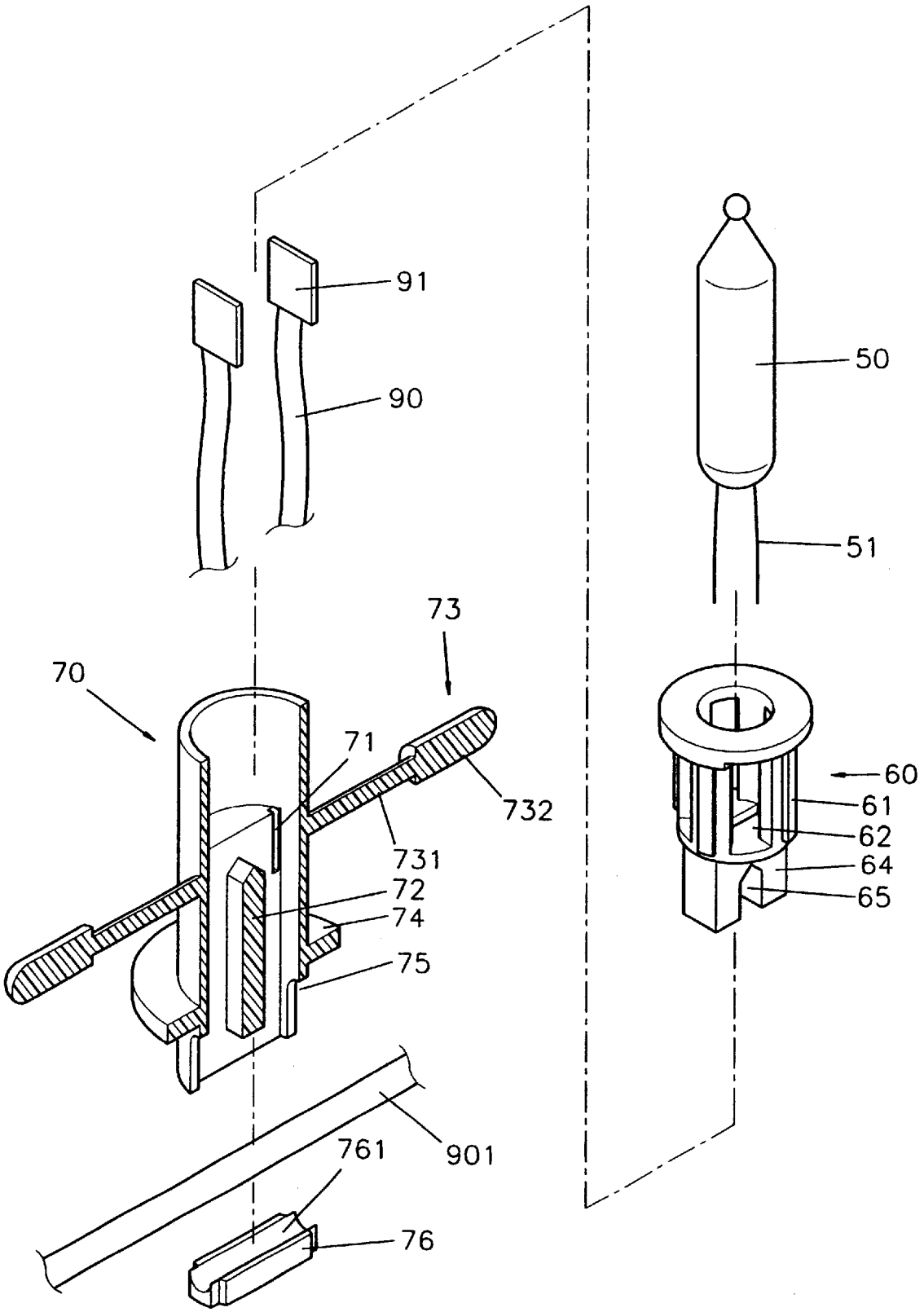
FIG. 4 is an exploded perspective view to show a preferred embodiment of the present invention.

With reference to FIG. 4 of the drawings, the combinable Christmas light of the present invention comprises generally a bulb 50, a base 60 and socket 70.

The base 60 has an opening in the top, a large diameter flange around the opening, a hollow cylinder body extending downward from the under side of the flange which is formed with a plurality of longitudinal ribs 61 to define a plurality of spaces 62 therebetween for quickly dispersing the heat from inside the base 60 and a pair of hollow extensions 64 parallel extending downward form the underside of the hollow cylinder body and communicating with the body and a notch 65 defined between the extensions 64.

The socket 70 has a pair of slots 71 symmetrically formed in opposing inner peripheral walls to receive a pair of conduct plates 91 respectively of a pair of electrical wires 90, a longitudinal partition 72 disposed in the center of the lower portion thereof for preventing the conduct plates 91 from touching each other, a pair of locking members 73 symmetrically extending outward of the opposing outer peripheries of the middle portion thereof each of which includes a flexible rod 731 and bead 732 at the free end of the rod 731, an annular flange 74 extending outward from an outer periphery under the locking members 73 and a pair of recesses 75 symmetrically formed in the opposing peripheral walls abutting the bottom thereof.

Figure 5:
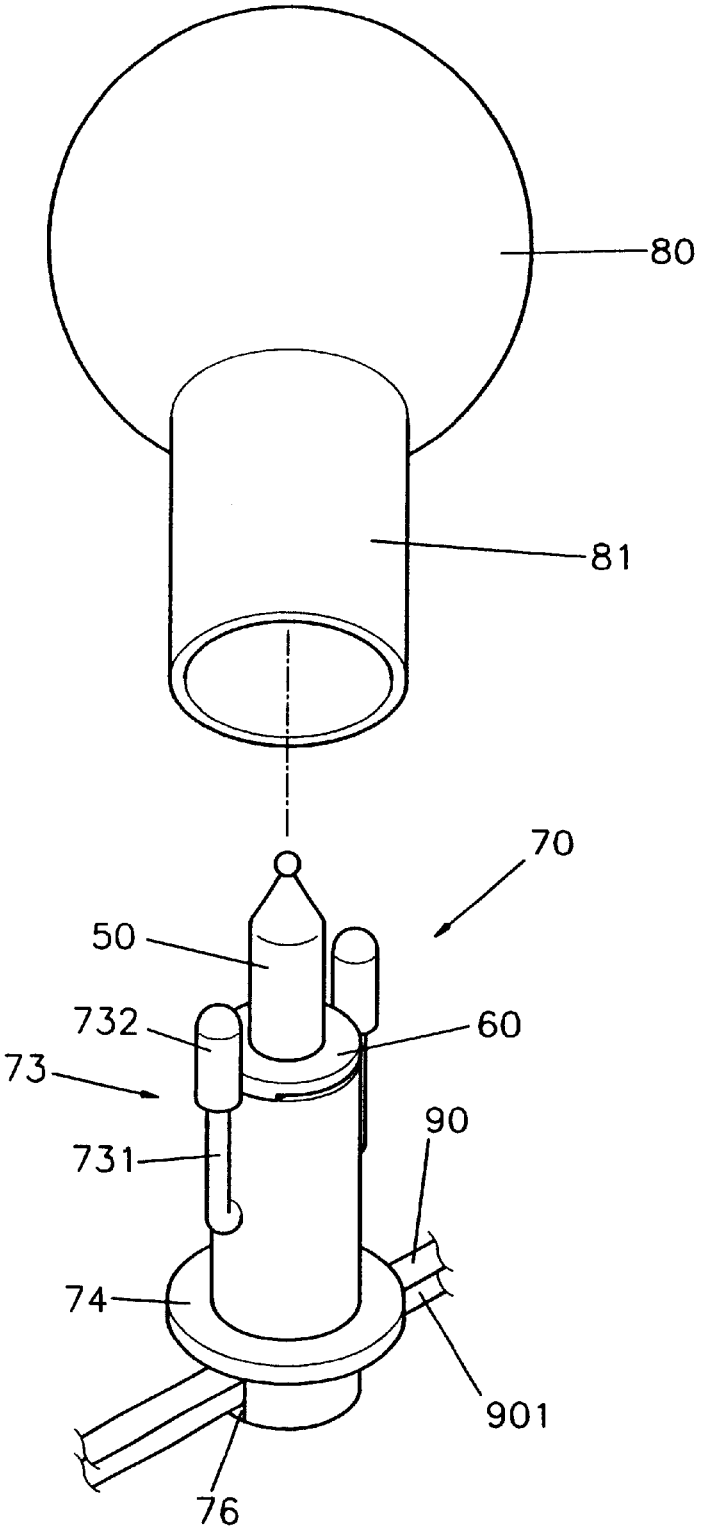
FIG. 5 is an exploded perspective view to show an assemblage of FIG. 4 and a transparent shade combinable with the Christmas light of the present invention.
Figure 6:
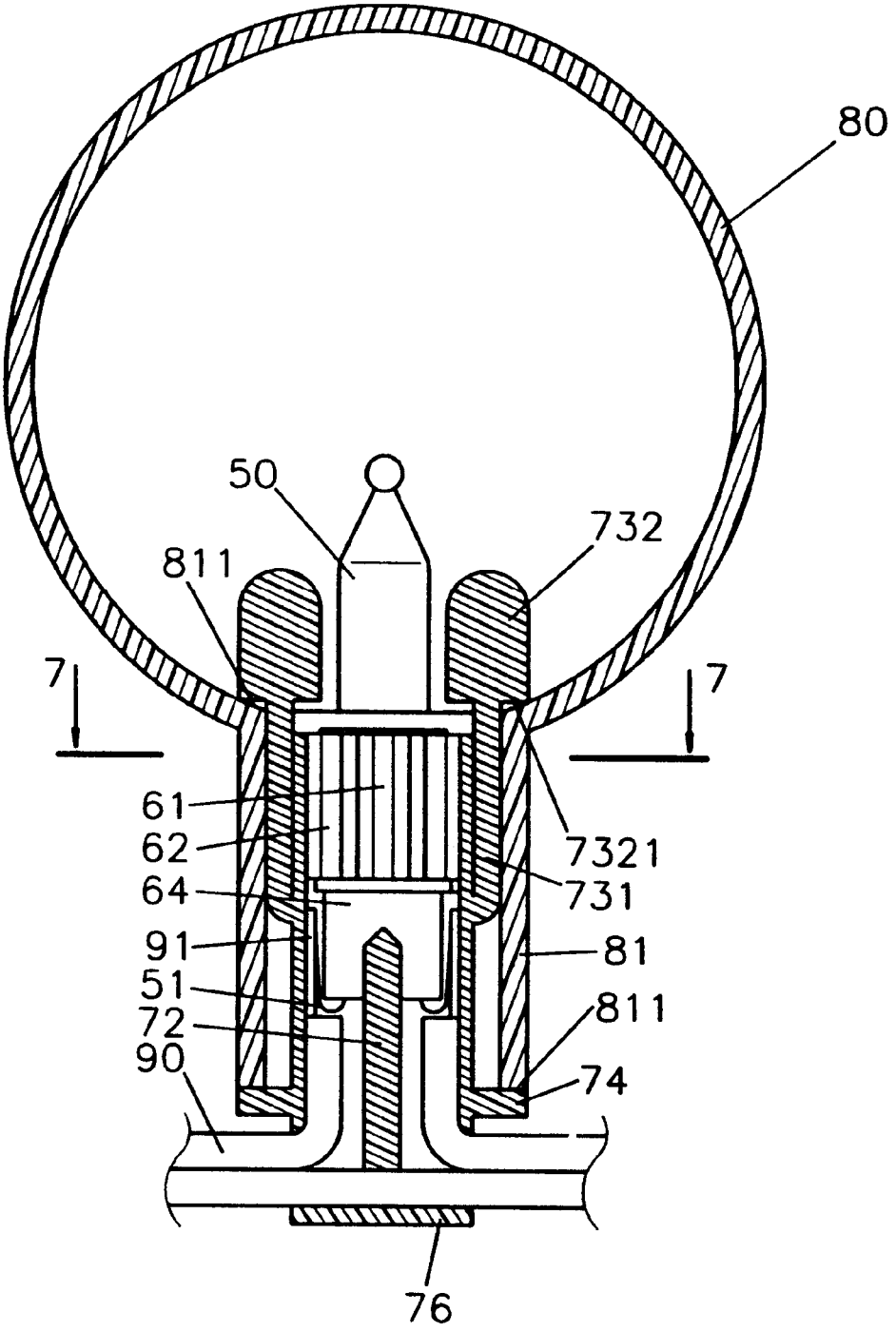
FIG. 6 is a sectional view of FIG. 5 offer that the transparent shade is combined with the light.
Figure 7:
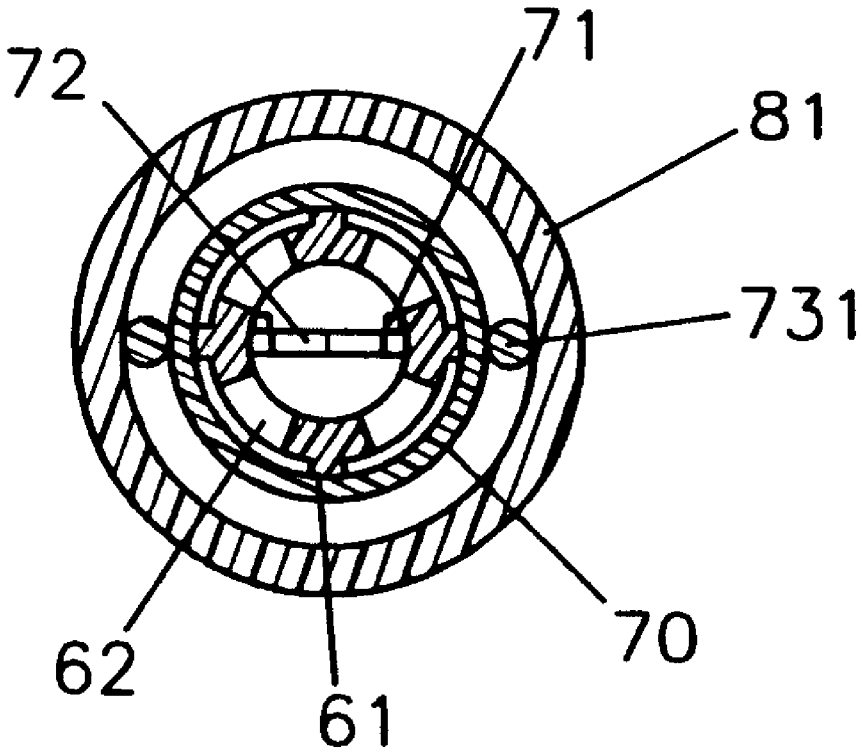
FIG. 7 is a sectional view taken along line 7—7 of FIG. 6.
Figure 8:
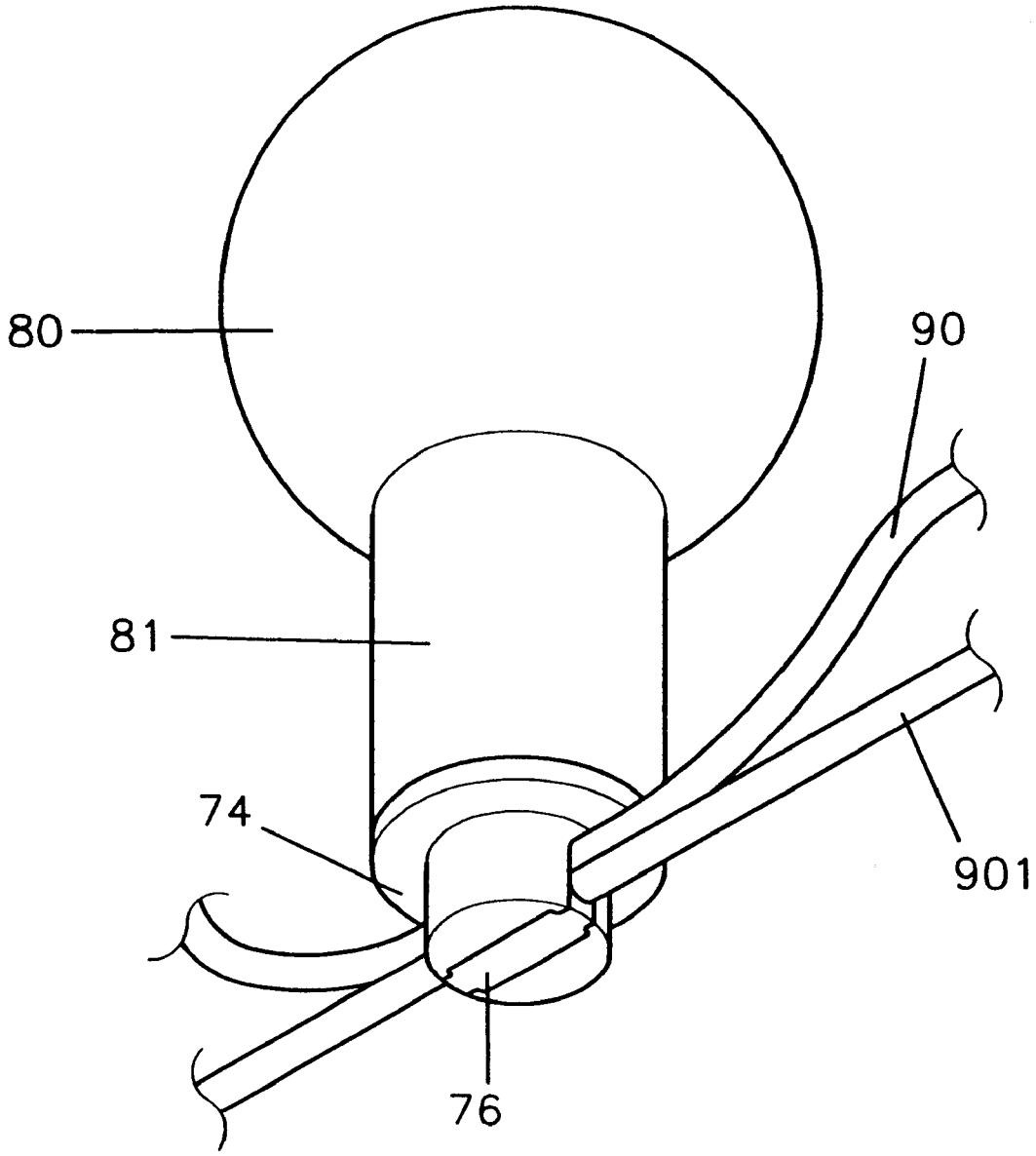
FIG. 8 is a perspective view of FIG. 6.

When assembling, the bulb 50 axially inserts into the opening of the base 60 with a pair of lead-in wires 51 respectively inserted through the extensions 64 and their free ends attached to the outer surfaces of the lateral sides thereof, then axially inserts the base 60 into the upper portion of the socket 70 in frictional manner while the lead-in wire automatically engage with the conduct plates 91 in the slots 71 and then respectively engages the pair of electrical wires 90 in the recesses 75 with a common electrical wire 901 disposed under the wires 91 perpendicular to the bottom of the socket 70, finally close the bottom of the socket 70 with a cap 76 which has an elongate groove 761 in the top formed in consistence with the shape of the wire 901. So that the external water will not permeate into the socket 70. FIG. 5 shown an assemblage of the Christmas light of the present invention while the pair of locking members 73 are bent toward upward, and a transparent shade in color 80 is ready to engage with the Christmas light. The shade has a tubular neck 81 enabling to cover the Christmas light and having an outer diameter equal to the diameter of the annular flange 71 of the socket 70 therefore providing a waterproof effect. FIGS. 6, 7 and 8 show the engagement of the transparent shade 80 with the Christmas light of the present invention wherein an inner periphery of the globe is latched by the underside of the bead 732. Because of that the bead 732 is also flexible, the tubular neck 81 of the transparent shade 80 is readily to sleeve in or to pull out of the light.

Figure 9:
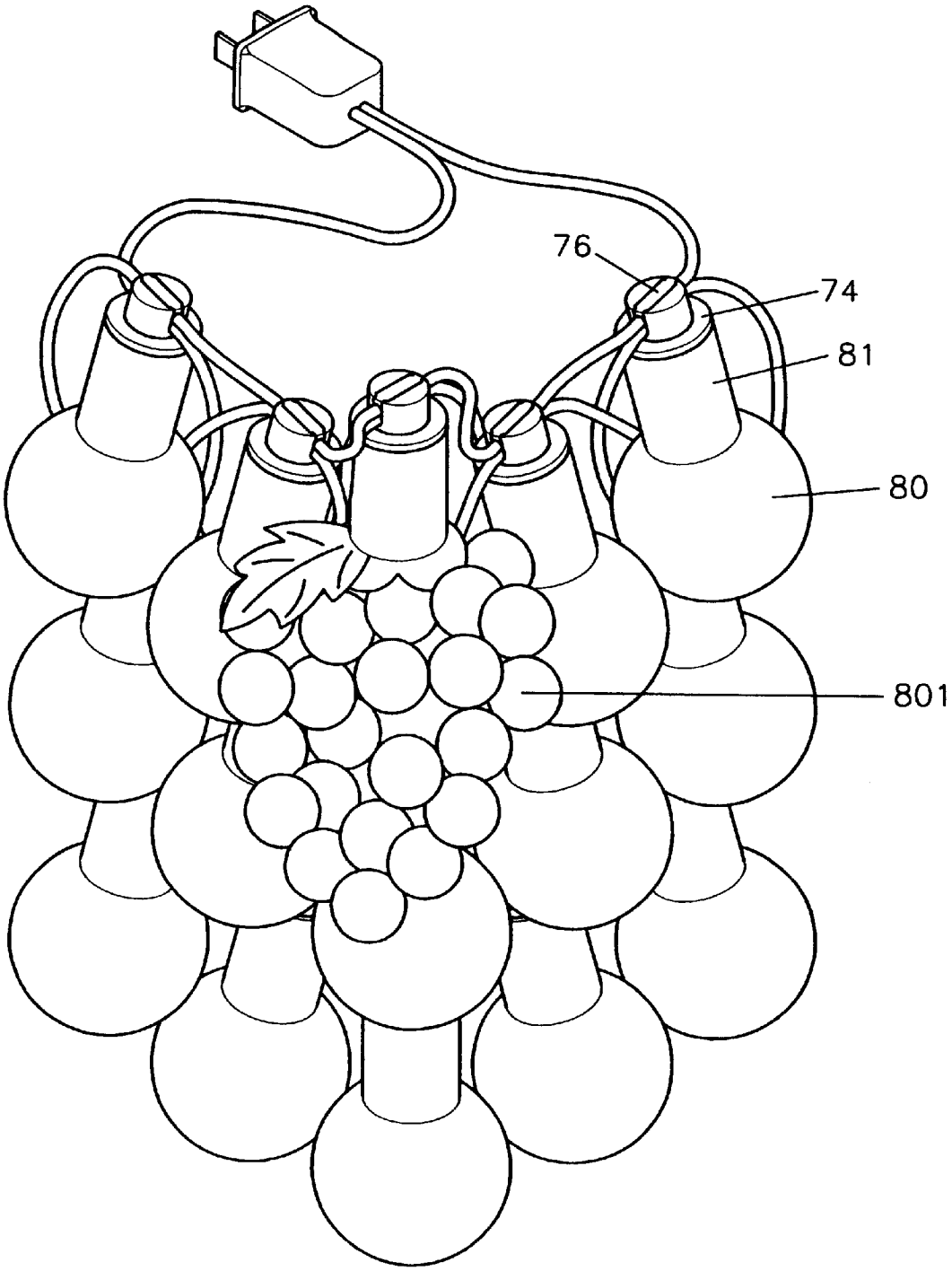
FIG. 9 is a perspective view to show a cluster arrangement of the Christmas lights of the present invention.

FIG. 9 shows a cluster arrangement of the Christmas lights of the present invention wherein each of the light is combined with a transparent shade 80 in color and a cluster of artificial grapes 801 is decorated in order to gain more cosmetic interesting.

Figure 10:
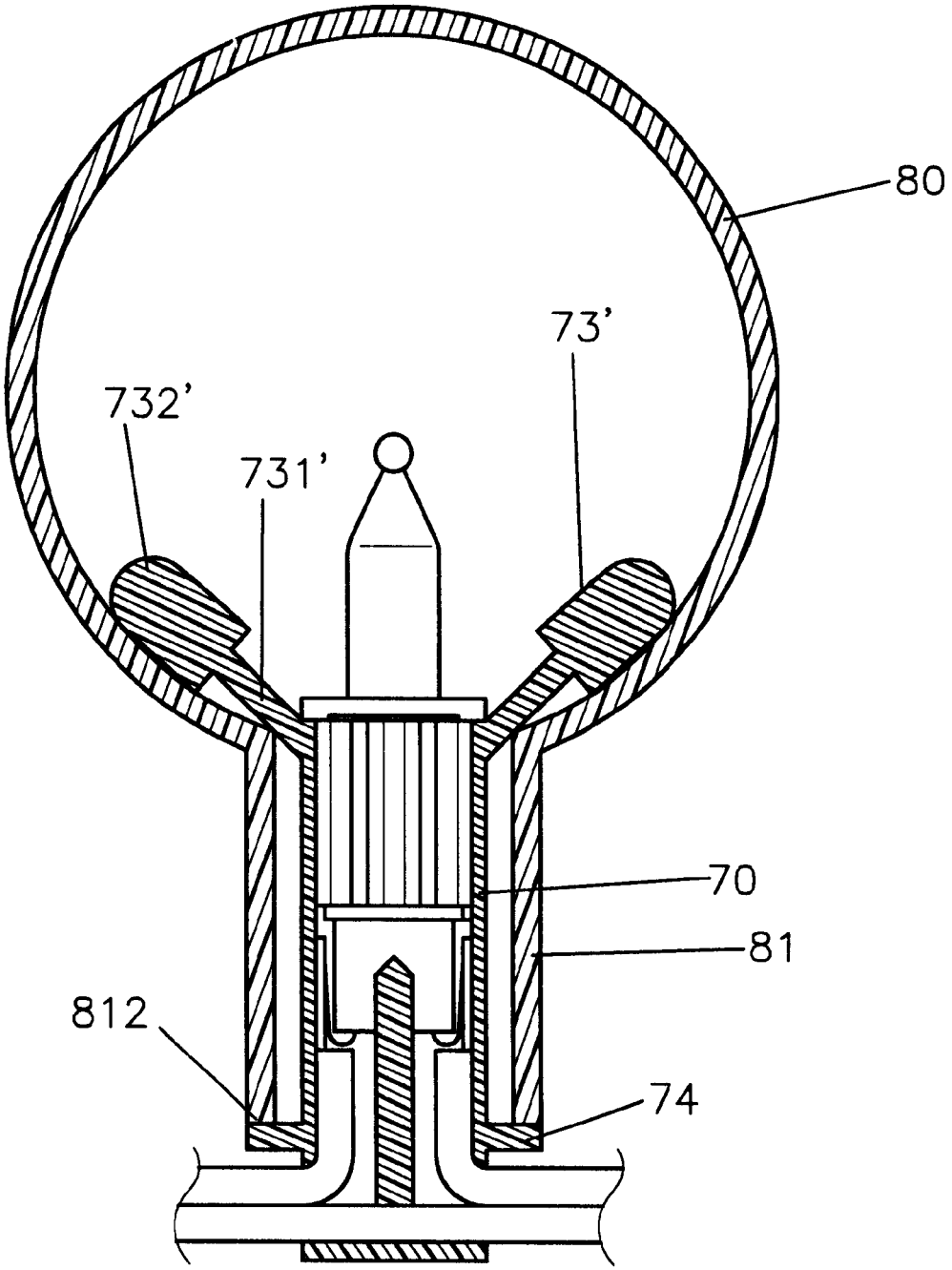
FIG. 10 is a sectional view to show an alternative embodiment of the pair of looking members of the present invention.

Referring to FIG. 10, an alternative embodiment of a pair of locking members 73' is provided. The locking members 73' is generally no different from the locking members 73. The only change is that the flexible rod 731' is shorter than the flexible rod 731, however, the bead 732' remains the same as the bead 732.

The specification relating to the above embodiments should be construed as exemplary rather than as limitative of the present invention, with many variation and modifications being readily attainable by a person of average skill in the art without departing from the spirit or scope thereof as defined by the appended claims and their legal equivalents.

I claim:

1. A combinable Christmas light comprising:

a socket having a first hollow interior cylinder body, an first upper opening, a lower opening, a pair of slots symmetrically formed in opposing inner peripheral walls for disposing respectively a pair of conduct plates from a pair of electrical wires from the lower opening thereof, a longitudinal partition disposed in center of lower portion thereof, a pair of locking members extending outward from opposing outer peripheries of middle portion thereof each including a flexible rod and bead at free end of the rod, an annular flange extending outward from a lower outer periphery under the locking members and a pair of recesses symmetrically formed in opposing peripheral walls abutting the lower opening thereof for respectively disposing the pair of electrical wire and a main electrical wire and closed with a cap which has an elongate groove in top part in consistence with the shape of the common electrical wire;

a base having a second hollow interior cylinder body, a second upper opening, a large diameter flange extending outward from the second upper opening, a tubular body extending downward from the large diameter flange, said tubular body including a plurality of longitudinal ribs therearound to define a plurality of longitudinal spaces therebetween and pair of hollow body and communicating with the tubular body and to define a notch therebetween;

a bulb axially disposed into the second upper opening of the base having a pair of lead-in wires inserted through the hollow extension respectively and attached to outer surfaces of the extension where enables to automatically engage with the conduct plates of the electrical wires;

a transparent lamp shade in color combined with said Christmas light and held by the beads of the locking members, said lamp shade including a hollow interior neck covering said socket and stopped against the annular flange of said socket having an outer diameter equal to the diameter of the annual flange.

2. The combinable Christmas light as claimed in claim 1 further includes a pair of altered locking members symmetrically extending outward from opposing outer peripheries of upper portion of said socket, each having a short flexible rod and a bead at free end of the rod.

* * * * *